United States Patent [19]

Kasuga

[11] 4,073,250

[45] Feb. 14, 1978

[54] INTERMITTENT DRIVE FOR SEWING MACHINE

[75] Inventor: Noboru Kasuga, Hachioji, Japan

[73] Assignee: Janome Sewing Machine Co., Ltd., Tokyo, Japan

[21] Appl. No.: 668,565

[22] Filed: Mar. 24, 1976

[30] Foreign Application Priority Data

Mar. 27, 1975 Japan ..... 50-36115

[51] Int. Cl.[2] ..... D05B 69/22

[52] U.S. Cl. ..... 112/274; 112/279

[58] Field of Search ..... 112/219 R, 220, 221, 112/67, 87; 192/45, 103 B, 56 L

[56] References Cited

U.S. PATENT DOCUMENTS

| | | | |
|---|---|---|---|
| 2,006,500 | 7/1935 | Gridley | 192/103 B X |
| 2,214,602 | 9/1940 | Arnold | 192/103 B |
| 2,521,943 | 9/1950 | Pitt | 192/103 B |
| 2,906,222 | 9/1959 | Ketterer et al. | 112/219 R |
| 3,058,437 | 10/1962 | Iida | 112/220 |
| 3,071,090 | 1/1963 | Zeier | 112/219 R |
| 3,108,670 | 10/1963 | Habicht | 192/45 X |
| 3,221,850 | 12/1965 | Bacon | 192/45 |

*Primary Examiner*—H. Hampton Hunter
*Attorney, Agent, or Firm*—Michael J. Striker

[57] ABSTRACT

A sewing machine motor is connected to a drive wheel which can be connected via a clutch to a drive shaft that vertically reciprocates the sewing-machine needle. A cam on the shaft and a stopper on the housing are displaceable between an operative position engageable with each other for stopping rotation of the shaft in a predetermined angular position corresponding to the up position of the needle and an inoperative position unengageable with each other. A cam is provided for displacing the control element of the clutch from an engaged to a disengaged clutch position on engagement of the stopper in its operative position with the cam so that the shaft can be arrested in a predetermined angular position and is substantially simultaneously rotationally uncoupled from the wheel. Pawls engageable with a cam carried on the shaft serve to substantially simultaneously displace the clutch control element into the engaged position and the stopper into the inoperative position for starting-up of the sewing machine again after one intermittent-drive cycle.

15 Claims, 19 Drawing Figures

INTERMITTENT DRIVE FOR SEWING MACHINE

BACKGROUND OF THE INVENTION:

The present invention relates to a sewing-machine drive. More particularly this invention concerns such a drive which allows intermittent driving of a sewing machine.

A sewing machine customarily has a needle that is vertically displaceable on a housing through a workpiece. A bobbin arrangement under the workpiece cooperates with the needle to form a row of stitches through the workpiece. Typically the machine has an electric drive motor whose output speed is variable by means of a foot pedal. Thus the sewing machine operator may sit at the machine and control the sewing speed with the foot control.

It is occasionally desirable, for basting operations or the like, to drive the sewing machine intermittently. This is normally done by providing the machine with a hand wheel so that the user may manually crank the needle up and down and sew stitch at a time. Between stitches the workpiece may be moved back and forth so that subsequently removable basting stitches can be placed in the workpiece with the machine. Such a system has the considerable disadvantage that the sewing-machine operator must use one hand to displace the needle up and down and the other hand to position the workpiece. When sewing a large garment or the like it is frequently necessary to guide and hold the workpiece with two hands so that such an operation is impossible.

Sewing machines have been designed which have an automatic drive arrangement that allows the machine to be driven in such a manner that it automatically stops after each stitch. Such devices normally incorporate complicated electromagnetic clutches in the drive along with limit switches so that the cost and complexity of the sewing machine is elevated. Furthermore, the violent stopping and starting of such machines leads to frequent breakdowns. The violent stopping and starting also is often extremly noisy and frequently does not stop the needle in the desirable up position.

SUMMARY OF THE INVENTION

It is therefore an object of the present invention to provide an improved sewing machine.

Another object is the provision of an improved intermittent drive for a sewing machine.

A further object is to provide an intermittent drive which operates smoothly and which can be incorporated into sewing machines for home use without prohibitively increasing the cost of such machines.

Yet another object is the provision of such an intermittent drive which is very compact and has a long service life.

The objects are attained according to the present invention in a sewing machine of the above-described general type wherein a drive shaft in the housing is operatively connected to the vertically displaceable needle and carries a drive wheel which can rotate relative this shaft. A clutch is provided on the shaft and engageable with the wheel and has a control element which is displaceable between an engaged position for rotationally coupling the wheel and the shaft and a disengaged position allowing free relative rotation of the wheel and the shaft. Thus when the motor constituting the drive means and connected to the wheel rotates the wheel in the engaged position of the clutch the sewing-machine needle is displaced between its up and down positions. Means is provided including a formation on the shaft and a stopper on the housing displaceable between an operative position engageable with each other for stopping rotation of the shaft in a predetermined angular position of the shaft corresponding to the up position of the needle and an inoperative position unengageable with each other. Further means is provided for displacing the clutch control element from the engaged to the disengaged position on engagement of the stopper in the operative position with the formation on the shaft so that the shaft can be arrested in the predetermined angular position and is substantially simultaneously rotationally uncoupled from the wheel. Finally means is provided for substantially simultaneously displacing the control element into the engaged position and the stopper into the inoperative position for starting-up of the machine again.

The clutch according to this invention is of the roller type and comprises a bushing rotationally fixed on the shaft at the wheel driven by the drive motor. A roller or ball is displaceable by the control element of the clutch between a position wedged between the bushing and the wheel and, therefore, rotationally coupling the two, and a loose position between these two elements in which they can rotate relative to each other.

Thus three separate cams are provided on the shaft. The first cam is integrally formed with the control element and has a lobe constituting the formation engageable with the stopper. This first cam is limitedly rotatable relative to the wheel on the shaft and is coupled thereto via at least one screw passing through at least one arcuate hole through the first cam. A bumper provided at the end of this hole greatly reduces shock and noise in the machine.

The second cam has a formation or lobe engageable with the stopper to displace it from the operative into the inoperative position. This cam is formed on its opposite face with a plurality of notches engageable with pawls carried on the wheel and effective when the wheel is stopped to drop into these notches and rotationally couple the wheel and the second cam. When thus coupled rotation of the wheel rotates the second cam and causes the projection thereon to push the stopper into the inoperative position, allowing the control element correspondingly to move into the engaged position and start the machine up again.

Accordingly to this invention the third cam which is rotationally fixed on the first cam has formations that can prevent the pawl or pawls from falling into the notches on the second cam. It is noted in this respect that the second cam is limitedly rotatable relative to the first and third cams between a first position in which the pawls can engage in the notches of the second cam and a second position in which they cannot. Only in the disengaged position of the clutch and a stopped position of the wheel can the pawls engage in the notches in the second cam. When the wheel is rotated these pawls are driven centrifugally outwardly away from the second cam.

In accordance with further features of this invention a hand wheel is provided on the shaft and allows the shaft to be manually positioned.

A motor-speed switch in accordance with this invention is coupled with the above-described stopper and only allows this stopper which is formed as a two-arm lever, to move into the operative position when the motor is being run at a relatively low speed.

Thus with the system according to the present invention it is possible for the operator to throw the motor switch to a low-speed intermittent-drive position in which each time the foot control is pressed the needle will reciprocate up and down once. At the end of each reciprocation, in the up position of the needle, this needle will stop even though the motor continues to rotate as the clutch between the needle-drive shaft and the motor-drive pulley is disengaged. The user must then release the foot control so that the pawls carried on the drive pulley and centrifugally driven outward by the rotation thereof can fall into the notches on the second cam and allow this cam to push the stopper into the inoperative position so that the needle can go up and down one more time. Thus it is possible for the sewing-machine operator to baste while using both hands to position the workpiece, and after each vertical reciprocation of the sewing-machine needle this operator can displace the workpiece with both hands into any desired new position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 6:
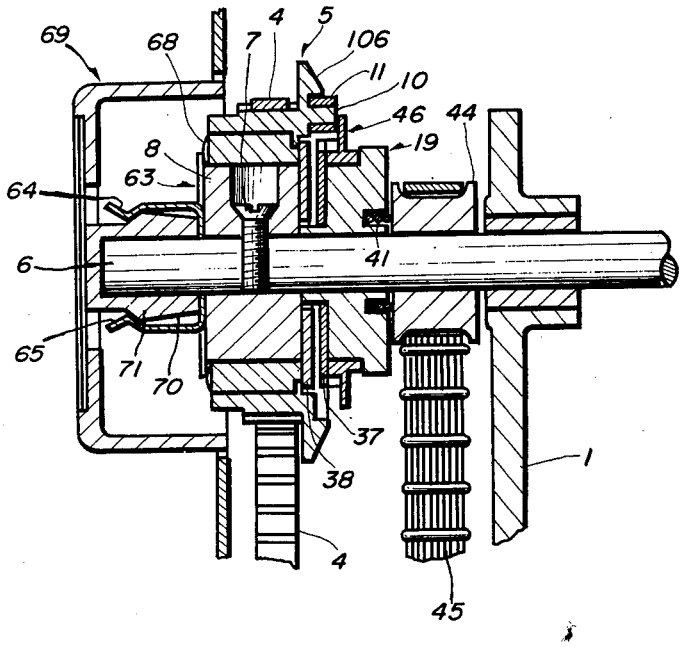
FIG. 6 is a section similar to FIG. 4 with some of the parts rotated through 90°.
Figure 7:
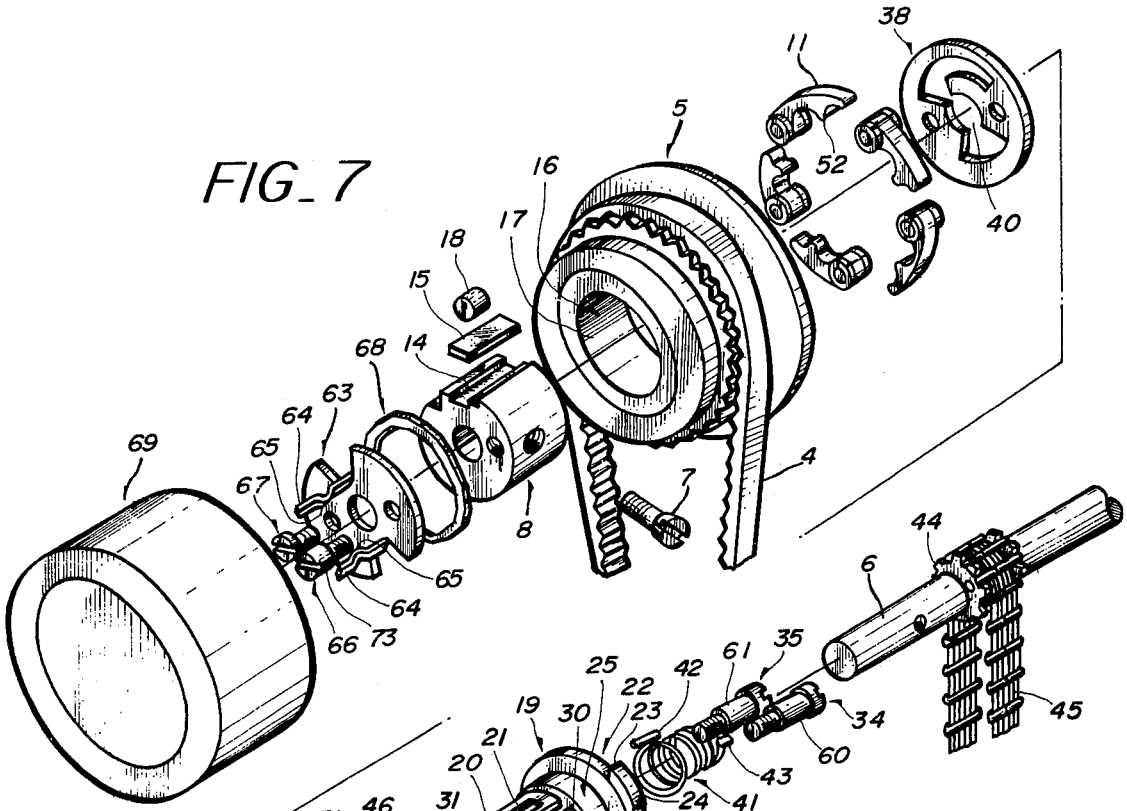
FIG. 7 is an exploded perspective view of the drive arrangement according to the present invention.
Figure 8:
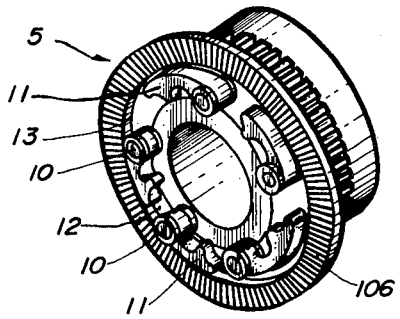
FIG. 8 is a perspective view of the drive pulley in accordance with this invention.

DESCRIPTION OF THE PREFERRED EMBODIMENTS:

As shown in FIGS. 1–8 a sewing machine has a housing 1 with a needle 116 and containing a motor 117 (see FIG. 2) that operates the machine through a belt 2. A foot control 101 has a plate 102 depressable to increase motor speed. An intermediate pulley 3 is mounted in the housing 1 and is driven through the belt 2 by the motor 117. Another belt 4 is spanned over the pulley 3 and in turn drives a pulley 5 rotatable on a bushing 8 fixed rotationally to an upper shaft 6 by a screw 7. Each full revolution of the shaft 6 vertically reciprocates the needle 116 one time. A clutch on the bushing 8 can rotationally interconnect the pulley 5 and the upper shaft 6. The pulley has five axially extending pins 10 fixed on its inner recessed face 106. A pawl 11 is carried on each of the pins 10 as seen in FIG. 8 in such a manner that rotation of the pulley 5 swings these pawls 11 outwardly by centrifugal force, pressing the radially outer sides against the inner wall 12 of the flange 13.

Figure 2:
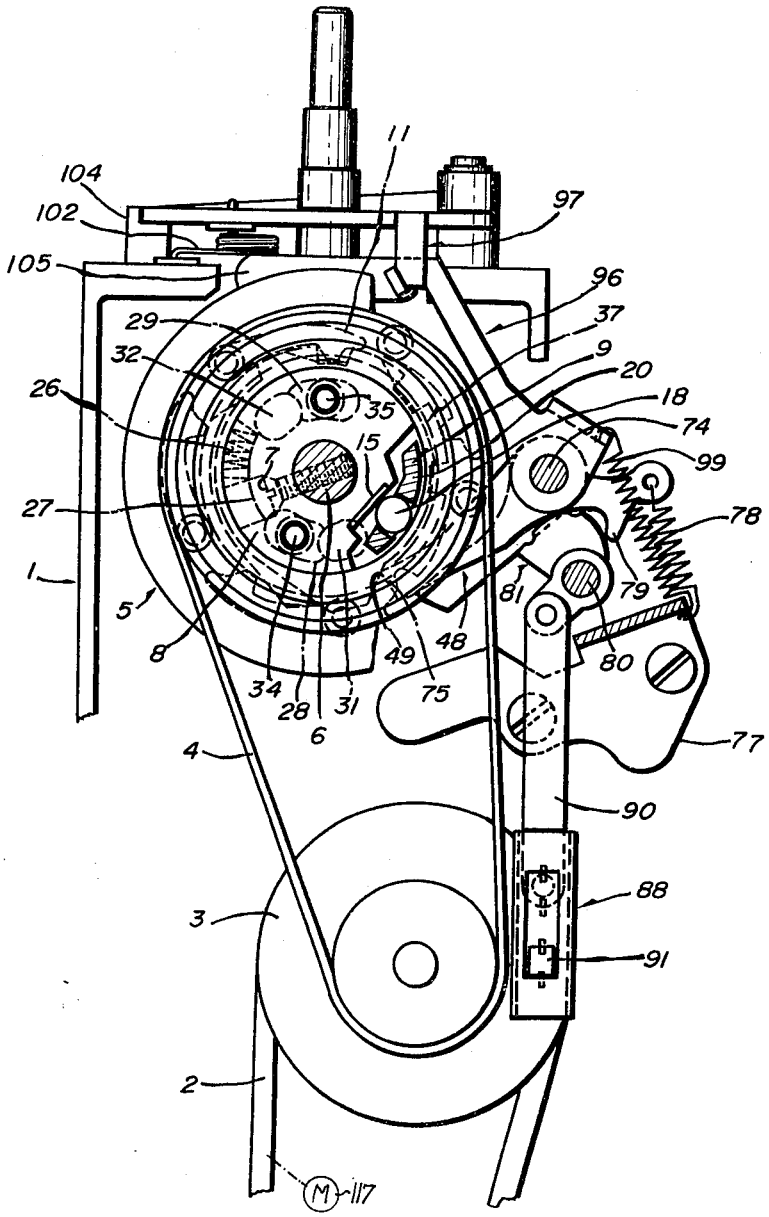
FIG. 2 is an end view of the sewing machine of FIG. 1.

As shown in FIGS. 2 and 7 the clutch 9 comprises a substantially flat plate 15 and a cylindrical roller 18. The flat plate 15 is fitted in the bottom of a groove 14 formed on the bushing 8 parallel to the upper shaft 6, and the roller 18 is fitted in turn in the space defined by the groove 14 and the inner peripheral surface 17 of the bore 16 of the pulley 5. The roller 18 also fits in and is held by an opening 21 of a transverse arm 20 projecting from a stopper cam 19. As the stopper cam 19 is turned counterclockwise relative to the bushing 8, the roller 18 shifts into a narrower space defined by the groove 14 and a part of the inner surface 17 of the bore 16 of the pulley 5 to rotationally connect the belt wheel 5 and the bushing 8 in sprag-fashion. Thus when the pulley 5 rotates, it rotates the upper shaft 6. On the contrary when the stopper cam 19 is turned clockwise relative to the bushing 8, the roller 18 is shifted to a wider space defined by the groove 14 of the bushing and a part of the inner periphery 17 of the axial bore 16 of the belt wheel 5. In this position rotation of the belt wheel 5 relative to the bushing 8 is possible.

The stopper cam 19 (shown in FIG. 7) is cylindrical and has an annular base 22 and an axial collar 25. The base 22 is formed with a cam lobe 24 having a shoulder 23 on its periphery. The collar 25 supports the axially extending arm 20 and is formed peripherally with an arcuate groove 27 receiving a coil spring 26. A pair of axial slots 28 and 29 are formed in the stopper cam 19 diametrically opposite each other. These slots 28 and 29 extend axially through the collar 25 and the annular base 22 of the stopper cam 19. One end 30 of each slot in the counterclockwise direction is enlarged, keyhole-fashion. Cushion elements or bumpers 31 and 32, which may be made of polyurethane or the like, have heads 33 inserted into the enlarged ends 30 of the slots 28 and 29. These bumpers 31 and 32 absorb impact which is applied to the stopper cam 19 by the upper shaft 6 via stepped screws 34 and 35 when the upper shaft 6 stops. The stepped screws 34 and 35 pass through the slots 28 and 29 and are screwed into the opposed face of the housing 8. The stopper cam 19 also has a central hub 36 which is inserted into axial openings 39 and 40 of a pawl wheel 37 and a washer 38 that holds this wheel 37 axially in place. A torque spring 41 which is mounted around the upper shaft 6 of the sewing machine and normally urges the stopper cam 19 counterclockwise relative to the upper shaft 6 (as seen in FIG. 7), has one end 42 inserted into the opposed face of the stopper cam 19 and another end 43 inserted into the opposed face of a sprocket 44 which is fixed on the upper shaft 6 and is in engagement with a timing belt 45 driven by the upper shaft and driving the lower shaft (not shown) and the related members of the sewing machine. Thus the spring 41 normally urges the clutch 9 into the position in which it rotationally couples the shaft 6 to the pulley 5.

As also shown in FIG. 7, a releasing cam 46 has a flange 47 of large diameter. On the side of the flange 47 facing the stopper cam 19 the releasing cam 46 is provided with a projection 49 for releasing a stopper 48 (FIG. 2) which is described below. On the opposite side of the flange 47 the releasing cam 46 is provided with a collar 51 of small diameter. The collar 51 is formed with four recesses 50 for receiving a tooth 52 on one of the pawls 11. The central bore 53 of the releasing cam 46 is substantially of the same diameter and axially of the same length respectively with the outer diameter and the axial length of the collar 25 of the stopper cam 19. The bore 53 fits on the collar 25 of the stopper cam 19. A radial projection or spline 55 is provided on the periphery 54 of the bore 53 of the releasing cam 46. When the releasing cam 46 and the stopper cam member 19 are fitted together, the coil spring 26 in the arcuate recess 27 of the collar 25 bears against the projection 55 and one end of the recess 27 in the clockwise direction. As a result the coil spring 26 applies an angular force to the releasing cam 48 in the counterclockwise direction relative to the bushing 8 (see FIGS. 17 and 18). Axial movement of the releasing cam 46 is limited by the pawl wheel 37 which is attached to the confronting face of the collar 25 of the stopper cam 19 by screws 56. The releasing cam 46 is free to turn within a limited angular distance relative to the stopper cam 19.

The pawl wheel 37 is provided with four cam notches 57 on its periphery. The teeth 52 of the pawls 11 are thick enough to engage simultaneously both the cam notches 57 and the periphery of the collar 51. If the releasing cam 46 is turned relative to the pawl wheel 17 when one of the teeth 52 of the respective pawls 11 is in engagement with one of the aligned recesses 50 of the releasing cam member 46 and the pawl wheel 37, the tooth 52 moves along the cam notch 57 (see FIGS. 7 and 13) and is pushed out of the recess 50 of the releasing cam 46. Diametrically opposite slots 58 and 59 of the pawl wheel 37 receive cylindrical portions 60 and 61 of the stepped screws 34 and 35, respectively, and an opening 62 of the pawl wheel 37 receives the arm 20 of the stopper cam 19. The washer 38 is fixed to the bushing 8 by means of the screws 34 and 35, and determines the axial position of the pulley 5 as it acts as a guide for the pulley 5 when it rotates relative to the bushing 8.

A holder 63 for a hand wheel 69 has a pair of spring arms 64 and 65 which are integral with the holder 63 and transversely bent to the side of the holder 63 axially facing the hand wheel 69 from diametrically opposite cutouts on the holder 63. The holder 63 is fixed to the confronting face of the bushing 8 by screws 66 and 67. An elastic wave washer 68 fits loosely around the bushing 8 between the holder 63 and the belt wheel 5, and is lightly pressed against the belt wheel 5 (see FIG. 4).

Figure 3:
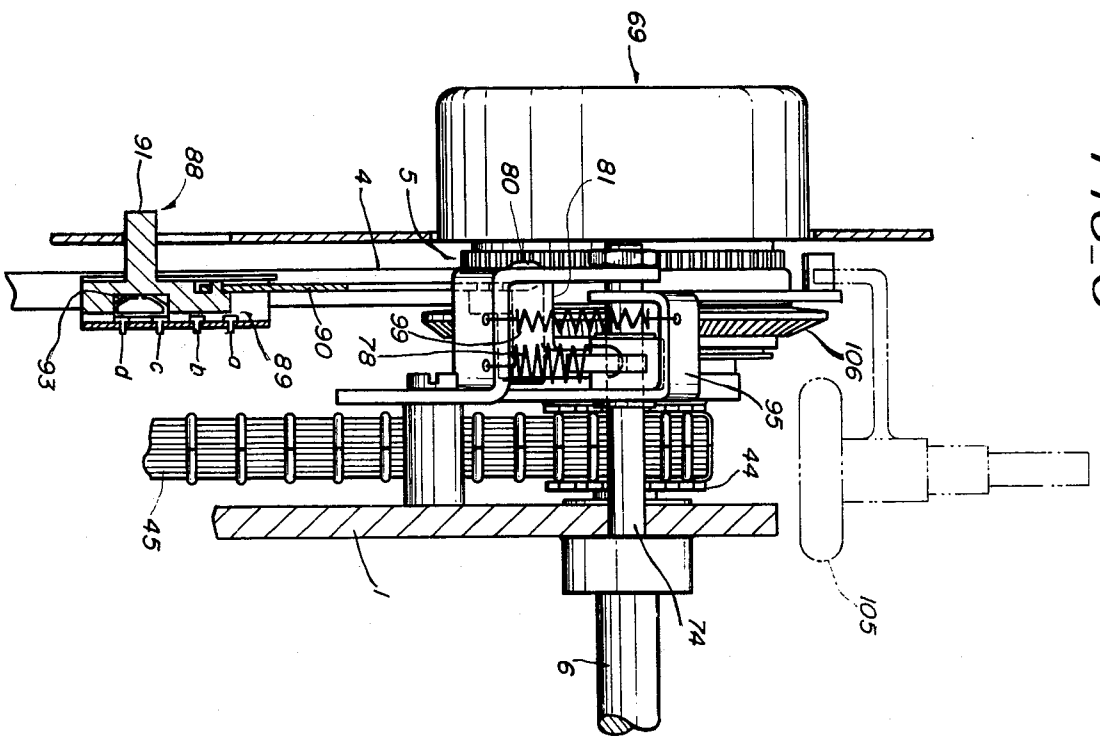
FIG. 3 is a rear side view of the sewing machine of FIG. 1.
Figure 4:
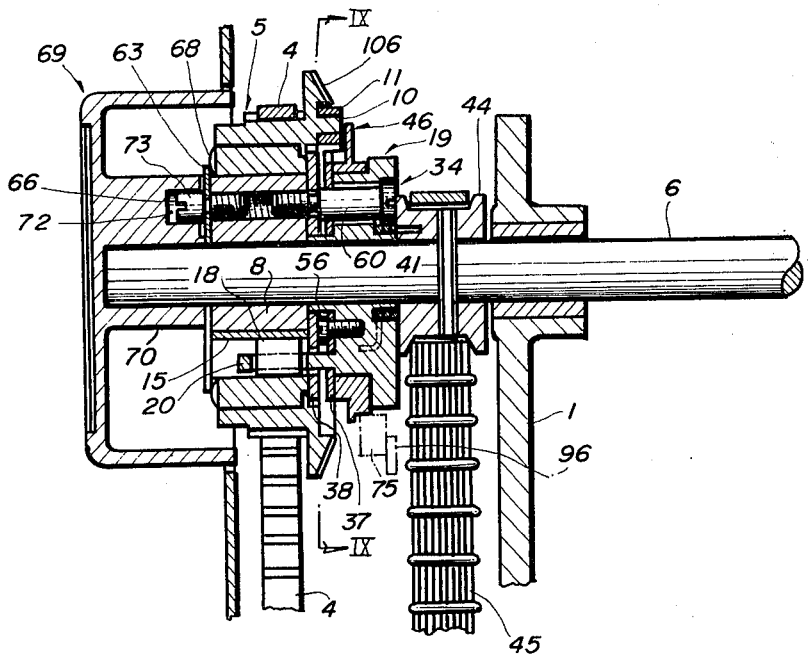
FIG. 4 is a vertical section through the structure of FIG. 3.

The hand wheel 69 shown in FIG. 6 is formed with a central hub 70 which is enlarged at its central portion 71. The enlarged portion 71 of the hub 70 is gripped by the pair of spring arms 64 and 65 of the holder 63 when the hand wheel 69 is mounted on the upper shaft 6 so that this hand wheel 69 is removably but securely mounted on the upper shaft 6. As shown in FIG. 4 the hub 70 of the hand wheel 69 is formed on eccentric hole 72 into which the cap head 73 of the screw 66 fits. The hand wheel 69 is, therefore, rotationally coupled to the upper shaft 6 and allows the machine operator to determine the angular position of the upper shaft 6 by hand. The hand wheel 69 can be removed from the upper shaft 6 by pulling it axially toward the left as seen in FIGS. 3 and 4.

As seen in FIGS. 8, 9, 11, 13, 15, 17 and 18, the two-arm stopper lever 48 is centrally pivoted on a shaft 74 fixed to the machine housing 1. One arm 75 of the lever 48 rides on the periphery 47 and the projection 49 of the stopper cam 46. The other arm 76 of the lever 48 is connected to one end of a tension spring 78, whose other end is anchored to a support plate 77 (see FIG. 2) to the machine housing 1. Thus the stopper lever 48 is usually urged in a clockwise direction as seen in FIG. 7. The stopper lever 48 is formed with a downward projection 79 between the pivot 74 and the arm 76 that engages a selecting cam 81 which is pivoted on a pin 80 fixed to the machine housing 1. The selecting cam 81 has a central hole 82, an arcuate portion 83, a recess 84 on one side of the portion 83, a recess 85 on the opposite side of the portion 83, a cam face 86 adjacent the recess 84 and an arm 87. The radius of curvature of the recesses 84 and 85 is the same as that of the projection 79 of the stopper lever 48.

The projection 79 can fit in the recesses 84 and 85 and hold the selecting cam 81 in either of two identical angular positions relative to the pin 80 in which the sewing machine continuously rotates at high or low speed for sewing normal continuous stitches. An electric connection is made at terminals 89 of a switch 88. An upright link 90 has its upper end connected to the arm 87 of the selecting cam 81 and its lower end connected to the slide 91 of the switch 88.The slide 91 is T-shaped and formed with a recess 92 at its back face. A connecting piece 93 fitted in the recess 92 has a flat inner face 94 that can electrically bridge the contacts *a–d* of the terminals 89 of the switch 88. When the connecting piece 93 bridges the contacts *a* and *b* the sewing machine is set to sew ordinary continuous stitches at high speed. When the connecting piece 93 bridges the contacts *b* and *c* the sewing machine is set to sew ordinary continuous stitches at low speed. When the connecting piece 93 bridges the contacts *c* and *d* the sewing machine is set to sew intermittent stitches.

Figure 5:
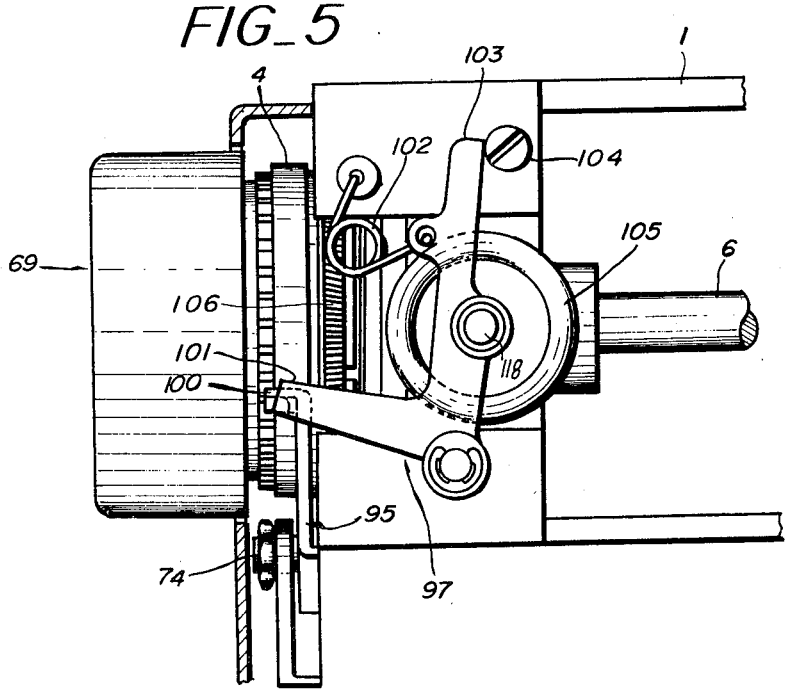
FIG. 5 is a plan end view of the structure of FIG. 4.

FIGS. 2, 3, 5 and 7 show a thread winding device having a two-arm lever 95 pivoted on the shaft 74 together with the stopper lever 48. One arm 96 of the lever 95 engages the stopper cam 19 when it is turned in the clockwise direction by a lever 97 having arms 101 and 103. A tension spring 99 is at its one end connected to the hole 98 in the double arm lever 95 and at its other end anchored to the support plate 77. Thus the double arm lever 95 is usually urged in the clockwise direction by the tension spring 99. The other arm 100 of the double arm lever 95 is engaged by the arm 101 of the lever 97 as shown in FIG. 5 and is usually urged in the counterclockwise direction against the action of the tension spring 99. The lever 97 is pivoted on the machine housing 1 and is usually placed in either of two stable end positions by a toggle spring 102 which urges the lever 97 until the arm 103 of the lever is stopped by a stop pin 104 which is fixed to the machine housing 1 (see FIG. 5). When the thread winding operation is carried out, the lever 97 is manually turned in the counterclockwise direction against the action of the bistable spring 102, and the rubber covered wheel 105, which is rotatably mounted a pin 118 (see FIG. 1) on the lever 97, is pressed against the toothed face 106 of the belt wheel 5. The lever 97 and the wheel 105 are pressed in this position by the bistable spring 102. When the thread winding device is set in this operating condition, the arm 101 of the lever releases the double arm lever 95.

Figure 1:
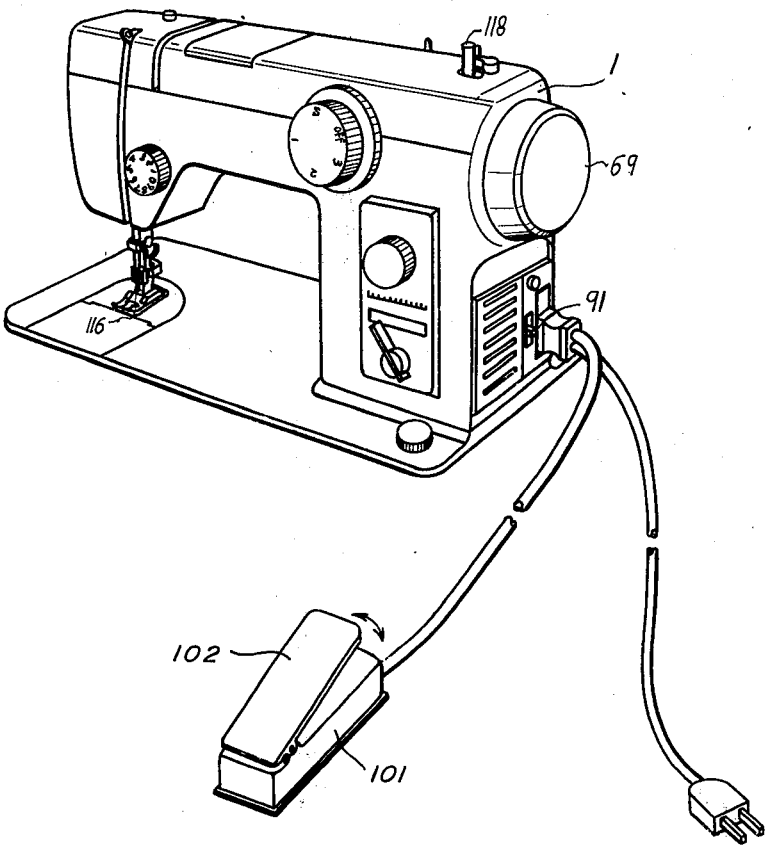
FIG. 1 is a perspective view of a sewing machine according to the present invention.

The apparatus fuctions as follows:

In order to set the sewing machine to sew ordinary continuous stitches, the slide 91 is shifted to the uppermost position to bridge the connecting piece 93 across the contacts *a* and *b*. Simultaneously an electric circuit (not illustrated) is energized to apply a voltage to the foot control 107 (FIG. 1). In accordance with the degree of pressure applied to the foot control lever 102 of the sewing machine, the machine motor 117 can be energized with a voltage between zero and the source voltage. Furthermore, when the slide 91 is shifted to the uppermost position, the link 90 is shifted upwardly and turns the selecting cam 81 in the counterclockwise direction, so that the projection 79 of the stopper lever falls in the recess 85 of the selecting cam 81. The stopper lever, therefore, is turned counterclockwise and the end 75 of the lever 48 is shifted out of the orbit of the arm lobe 24 of the stopper cam 19 and of the projection 49 of the releasing cam 46. The stopper cam 19 is, therefore, turned in the counterclockwise direction by the spring 41 and accordingly the roller 18 of the clutch 9 is shifted into the narrow space between the periphery 17 of the bore 16 of the belt wheel 5 and the groove 14 of the bushing 8. Thus the pulley 5 and the upper shaft 6 are rotationally coupled. Depression of the foot-control lever 102 causes the upper shaft 6 of the sewing machine to rotate and ordinary continuous stitches are produced.

When the slide 91 is shifted to the intermediate position where the connecting piece 93 bridges the contacts *b* and *c*, an electric circuit is closed that continuously drives the sewing machine at low speed. In both cases, the upper shaft 6 and, therefore, the hand wheel 69 stop at a random angular position after the foot control is released to deenergize the machine motor 117. The desired needle position after such stopping of the sewing machine can be obtained by manually rotating the wheel 69.

Figure 10:
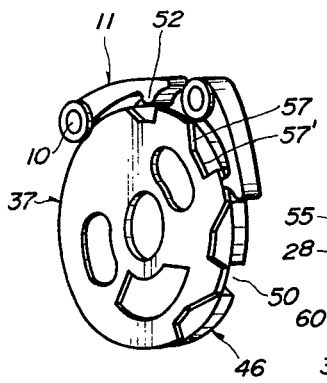
FIG. 10 is a perspective view of a detail of FIG. 9.
Figure 9:
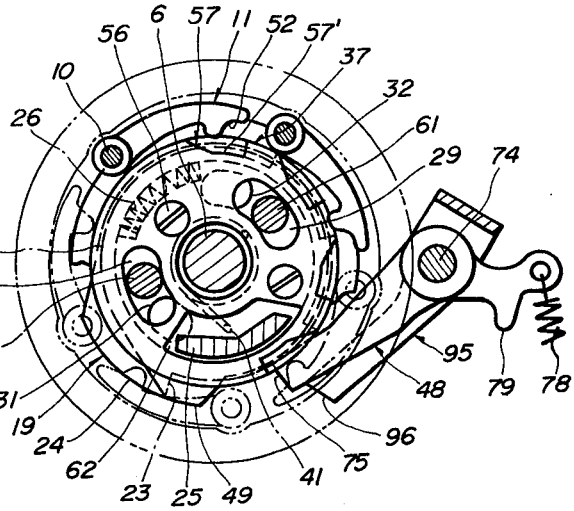
FIG. 9 is a section taken along line IX—IX of FIG. 4.
Figure 12:
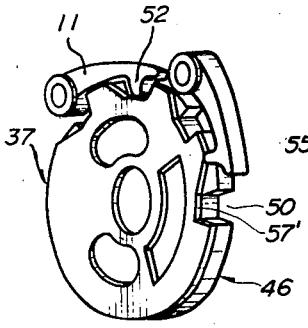
FIGS. 11 and 12 are views similar to FIGS. 9 and 10 showing the parts in a different functional position.

For intermittent drive the operating slide 91 is shifted to the lowermost position where the connecting piece 93 bridges the contacts *c* and *d*, the selecting cam 81 is turned counterclockwise, and the stopper lever 48 is turned clockwise by the tension spring 78 until the projection 79 of the lever 48 engages the cam face 86 of the selecting cam 81. Thus the arm 75 of the stopper lever 48 is shifted into the orbit of the cam lobe 24 of the stopper cam 19 and of the projection 49 of the releasing cam 46. At this time as shown in FIGS. 9 and 10, the releasing cam 46 and the pawl wheel 37 are so arranged that the cam projections 50' of the member 46 are axially aligned with the recesses 57' of the wheel 37 and the cam projections 57 of the wheel 37 are aligned with the recesses 50' of the member 46. When the foot control is actuated, the upper shaft 6 is rotated at a low speed, and the projection 49 of the releasing cam 46 approaches the end 75 of the stopper lever 48. The stopper cam 19 is rotated by the upper shaft 6 through the intermediate spring 41 and the releasing cam 46 is rotated by the stopper cam member 19 through the intermediate coil spring 26.

Figure 11:
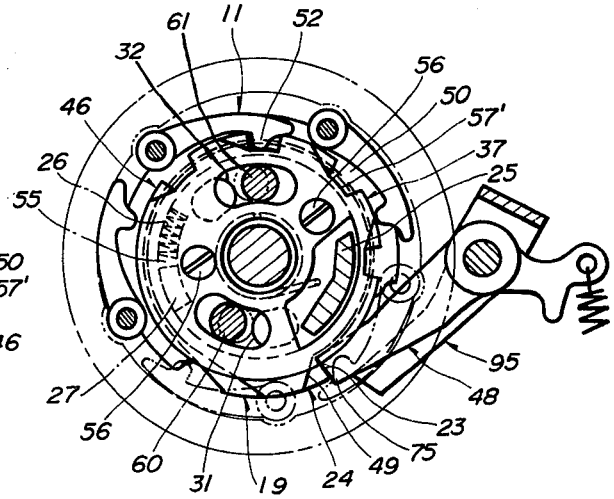
Figure 14:
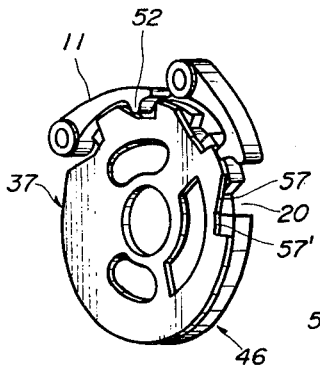
FIGS. 13 and 14 are views similar to FIGS. 9 and 10 also showing the arrangement in yet another operative position.

When the projection 49 of the releasing cam 46 engages the end 75 of the stopper lever 48 as shown in FIG. 11, the releasing cam 46 is rotationally arrested. The stopper cam 19, however, continues to rotate against the force of the spring 26 and is stopped when the shoulder 23 of the cam lobe 24 engages the end 75 of the stopper lever 48. The upper shaft 6, therefore, is rotationally arrested. In this position the releasing cam 46 and the pawl wheel 37 are so arranged that the cam projections 50' of the member 46 and the cam projections 57 of the wheel 37 are aligned respectively and that the recesses 50 of the member 46 and the recesses 57' of the wheel 37 are also aligned. One of the pawls 11 on the pulley 5 can thus drop into one of the aligned recesses 50, 57'. Since the pulley 5 rotates continuously, the pulley 5 pulls away from the roller 18 of the clutch 9 so that this roller 18 is shifted to a side space between the periphery 17 of the bore 16 of the pulley 5 and the groove 14 of the bushing 8 in such manner that the roller 18 is spaced from the periphery 17 of the bore 16 of the pulley 5. Consequently, the pulley 5 is rotationally disconnected from the bushing 8 and the upper shaft 6 and rotates relative to the upper shaft 6 as long as the foot controller is pressed. Since the bushing 8 and the upper shaft 6 have considerable inertia, the upper shaft 6 comes to a standstill only after the bushing 8 rotates through an angular distance corresponding to the length of the arcuate slots 28 and 29 and the screws 34 and 35 with the cylindrical portions 60 and 61 bumping against the elements 31 and 32 in the slots 28 and 29. The impact at the stopping time of the upper shaft 6 is absorbed by these bumpers 31 and 32 so that sound or noise which would otherwise be produced each time the sewing machine is stopped during such intermittent stitching is reduced to a minimum. The upper shaft 6 always stops in a predetermined angular position so that the machine needle 116 stops at the upper dead point where the needle is disengaged from the sewing workpiece. The pulley 5 continues to rotate relative to the upper shaft 6 as long as the foot control is pressed down so that the pawls 11 on the belt pulley 5 are centrifugally swung radially outwardly and move the pawls 11 will engage with its projection 52 into the aligned recesses 50 and 57' of the releasing cam 46 and of the pawl wheel 37, respectively.

When the foot control 101 is released the pulley 5 comes to a standstill and the uppermost pawl 11 on the stopped pulley 5 can drop into one of the aligned recesses 50 and 57' of the stopper cam 19 and the releasing cam 46 as illustrated in FIG. 11. Since the pulley 5 stops randomly a pawl 11 is not always aligned with a recess 50, 57'. A short actuation of the foot control; however, will cause a pawl 11 to drop into a recess 50, 57'.

Figure 13:
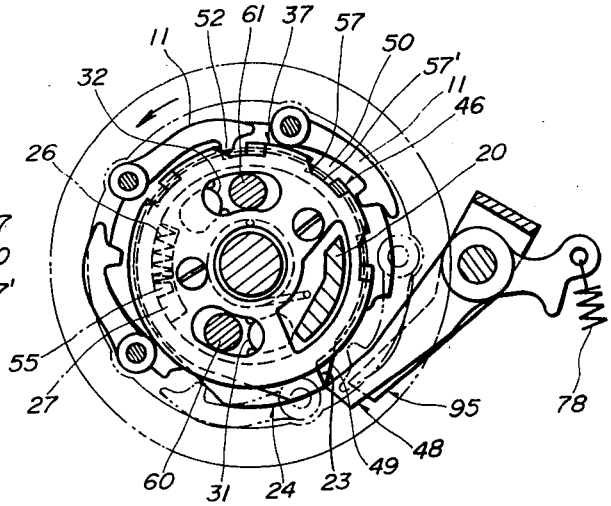
Figure 15:
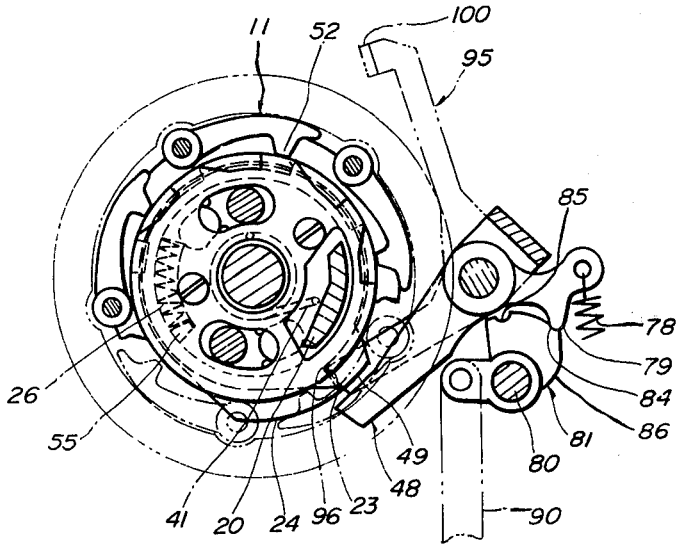
FIG. 15 is a view similar to FIG. 9 with the elements in yet another position.
Figure 16:
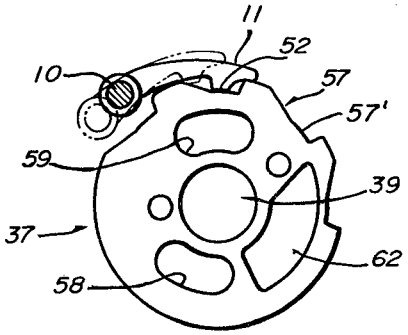
FIG. 16 is a view similar to FIG. 10 showing the arrangement in a further position.
Figure 17:
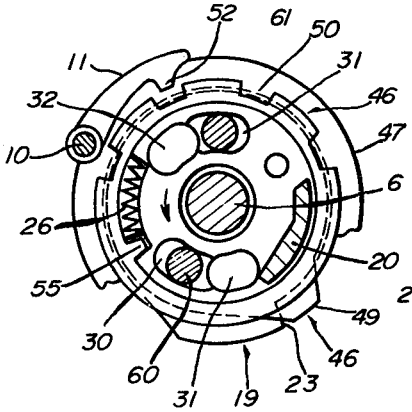
FIGS. 17 and 18 are end sectional views illustrating operation of the device in accordance with this invention.
Figure 18:
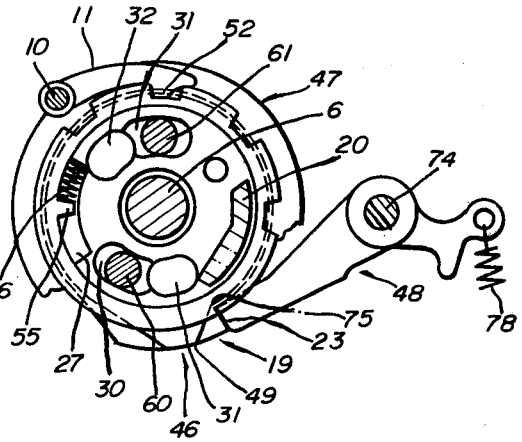

Subsequent actuation of the foot control rotates the pulley 5 in the direction indicated by the arrow in FIG. 13. The pawl 11 which is engaged in one of the aligned recesses 50, 57', rotates the releasing cam 46 while allowing the compression spring 26 to expand in the cam 46 as illustrated in FIGS. 13 and 15. As the pulley 5 rotates the tooth 52 slides up the sloped face of the recess 57 of the pawl wheel 37 which extends from the bottom of the recess to the radial periphery direction illustrated by the arrow in FIG. 17. Thus the tooth 52 of the pawl 11 moves to the upper periphery of the pawl wheel 11 and of the releasing cam 46 while rotating the releasing cam as illustrated in FIGS. 13 and 17. Simultaneously the lobe 49 of the releasing cam 46 pushes the end 75 of the stopper lever 48 against the force of the tension spring 78 to disengage the end 75 of the lever 48 from the shoulder 23 of the cam lobe 24 on the periphery of the upper cam 19. As a result the hitherto loaded spring 41 around the upper shaft 6 turns the stopper cam 19 relative to the bushing 8 in the direction indicated by the arrow in FIG. 13 to move the roller 18 of the clutch 9 to the narrow space between the groove 14 of the bushing 8 and the bore face 17 of the pulley 5 and rotationally recouple the pulley 5 and the bushing 8. The upper shaft 6 is again rotated by the motor 117. One stitch is then sewn and the upper shaft 6 again stops at a predetermined angular position after one complete rotation in accordance with the above-described sequence of steps. In this manner the upper shaft 6 of the sewing machine is stopped at a predetermined angular position after one complete rotation each time the foot control of the sewing machine is operated. Thus the operator of the sewing machine is able to use both hands to position the workpiece during basting and is able between stitches to shift with both hands the sewn material under the raised machine needle.

Figure 19:
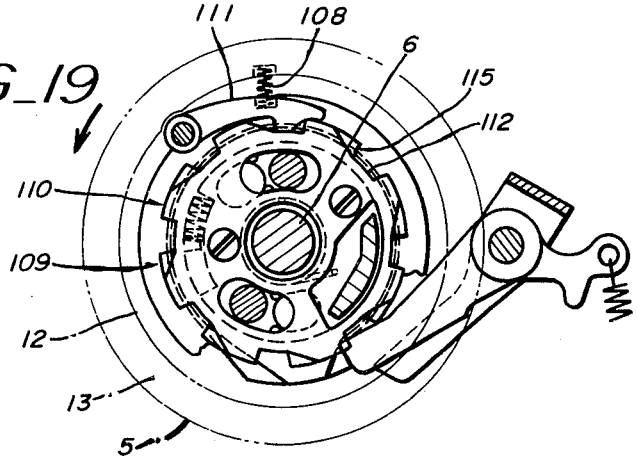
FIG. 19 is a view similar to FIG. 18 illustrating another arrangement according to the present invention.

In FIG. 19, a single pawl 111 is pivoted on the pulley 5 in the same manner as the pawls 11 of FIG. 7. The pawl 111 is normally pressed against the periphery of the releasing cam 109 and of the pawl wheel 110 by a compression spring 108 provided between the back of the pawl 111 and the inner transverse peripheral wall 12 of the flange 13 of the belt wheel 5. The pawl 111 is turned in radially outwardly direction relative to the pulley 5 against the action of the spring by centrifugal force when the pulley 5 is rotated in the direction indicated by the arrow in FIG. 19. In this arrangement, the releasing cam 109 and the pawl wheel 110 are provided with alternate recesses and projections all around their peripheries.

For thread winding the operating slide 91 of the switch 98 is shifted to the upper or intermediate position in which the connecting element 93 bridges the contacts *a* and *b* or the contacts *b* and *c* for driving the sewing machine at high or low speed to sew ordinary continuous stitches. Simultaneously the stopper lever 48 is turned counterclockwise against the force of the tension spring 78 and the end 75 of the lever 48 is brought out of the orbit of the lobe 24 of the stopper cam 19 and of the projection 49 of the releasing cam 46. Then the lever 97 as in FIG. 4 is manually turned counterclockwise against the force of the toggle spring 102 so as to press the rubber-covered wheel 105 rotatable on the lever 97 against the toothed face 106 of the flange 13 of the pulley 5. The double arm lever 95 at the same time released and turned clockwise by the force of the spring 99 as shown in FIG. 6 and the arm 96 of the lever 95 is brought into the orbit of the cam lobe 24 of the stopper cam 19 which is stopped when the foot control is pressed and the shoulder 23 of the lobe 24 engages the arm 96 of the double arm lever 95 during its rotation. As a result, the roller 18 of the clutch device 9 is shifted to the wide space defined by the groove 14 of the bushing 8 and the inner periphery 17 of the central bore 16 of the belt wheel 5 so that the roller 18 is spaced from the inner periphery 17 of the bore 16 and the pulley 5 rotates relative to the bushing 8 and the upper shaft 6. A thread can be thus wound on a bobbin mounted on the vertical shaft of the wheel 105 as illustrated in FIGS. 2 and 3.

It will be understood that each of the elements described above, or two or more together, may also find a useful application in other types of machines differing from the types described above.

While the invention has been illustrated and described as embodied in a sewing machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A sewing machine comprising:

a housing;

a needle on said housing displaceable between a down position engaging through a workpiece and an up position disengaged therefrom;

a drive shaft on said housing operatively connected to said needle;

a drive wheel on said shaft rotatable thereon relative to said shaft;

means including a clutch having one clutch member mounted on and jointly rotatable with said shaft, another clutch member operatively engageable between said one member and said wheel, and a control element operatively connected to said other member and displaceable between an engaged position for rotationally coupling said wheel and said shaft and a disengaged position for free relative rotation of said wheel and said shaft;

drive means connected to said wheel for rotating same and, in said engaged position of said clutch, for vertically reciprocating said needle between said up and down positions;

means including a formation on said shaft and a stopper on said housing displaceable between an operative position engageable with each other for stopping rotation of said shaft in a predetermined angular position corresponding to said up position and an inoperative position unengageable with each other;

means for displacing said control element from said engaged to said disengaged position on engagement of said stopper in said operative position with said formation, whereby said shaft can be arrested in said predetermined angular position and is substantially simultaneously rotationally uncoupled from said wheel; and means for substantially simultaneously displacing said control element into said engaged position and said stopper into said inoperative position.

2. The machine defined in claim 1, wherein said drive means includes a motor, means operatively connecting said motor to said wheel, and means for varying the motor speed.

3. The machine defined in claim 1, further comprising an operating element connected to said stopper for displacing said stopper between said operative and said inoperative positions.

4. The machine defined in claim 1, wherein said one clutch member is a bushing rotationally fixed on said shaft at said wheel and said other member is a roller displaceable on said bushing between a position engaging both said bushing and said wheel and a position engaging only said bushing, said control element having a cutout receiving said cam roller.

5. A sewing machine comprising:

a housing;

a needle on said housing displaceable between a down position engaging through a workpiece and an up position disengaged therefrom;

a drive shaft on said housing operatively connected to said needle;

a drive wheel on said shaft rotatable thereon relative to said shaft;

means including a clutch on said shaft between said shaft and said wheel and having a control element displaceable between an engaged position for rotationally coupling said wheel and said shaft and a disengaged position for free relative rotation of said wheel and said shaft;

drive means connected to said wheel for rotating same and, in said engaged position of said clutch, for vertically reciprocating said needle between said up and down positions;

means including a formation on said shaft and a stopper on said housing displaceable between an operative position engageable with each other for stopping rotation of said shaft in a predetermined angular position corresponding to said up position and an inoperative position unengageable with each other;

means including a cam lobe operatively connected to said control element and operatively engageable with said stopper only in the operative position thereof for displacing said control element from said engaged to said disengaged position on engagement of said stopper in said operative position with said formation, said cam lobe being rotatable with said shaft and being relative to the normal direction of rotation of said shaft by said drive means ahead of said formation, whereby said stopper engages said cam lobe to disengage said control element and thereafter engages said formation to stop said shaft; and means for substantially simultaneously displacing said control element into said engaged position and said stopper into said inoperative position.

6. The machine defined in claim 5, wherein said stopper is a lever pivoted on said housing and having an end engageable with said lobe and with said formation.

7. The machine defined in claim 1, wherein said means for simultaneously displacing includes a first cam rotationally carried on said shaft and operatively engageable with said stopper in the operative position thereof to displace same into said inoperative position.

8. The machine defined in claim 7, wherein said means for simultaneously displacing includes at least one pawl engageable in said cam to rotationally arrest same and cam said stopper into said inoperative position.

9. The machine defined in claim 1, further comprising an actuator limitedly rotatable on said shaft and formed with said control element and with said formation.

10. The machine defined in claim 9, wherein said means for simultaneously displacing includes a cam carried on said actuator and having a projection engageable with said stopper to displace same from said operative into said inoperative position.

11. The machine defined in claim 10, wherein said actuator is formed with at least one arcuate throughgoing hole, said actuator being provided with a screw passing through said hole and with an elastic bumper at one end of said hole resiliently engageable with said screw.

12. The machine defined in claim 1, wherein said clutch includes a spring normally urging said control element into said engaged position.

13. The machine defined in claim 1, wherein said means for substantially simultaneously displacing includes at least one pawl carried on said wheel and a cam on said shaft having a recess, said pawl having a projection engageable in said recess, said projection being centrifugally displaced out of said recess on rotation of said wheel.

14. The machine defined in claim 13, wherein said cam is limitedly rotatable on said shaft relative to said wheel and has a spring engaged between said cam and said wheel normally urging said cam in a predetermined rotational sense relative to said wheel.

15. The machine defined in claim 13, wherein said wheel has a spring normally urging said pawl toward said cam.

* * * * *